United States Patent [19]

Nelson et al.

[11] 4,395,065

[45] Jul. 26, 1983

[54] DOOR STOP MECHANISM

[76] Inventors: Ben L. Nelson, Rte. #1, Box 4995, Bonita Springs, Fla. 33923; Leonard L. Hayes, 1906 - 10th Ave., Lewiston, Id. 83501

[21] Appl. No.: 297,872

[22] Filed: Aug. 31, 1981

[51] Int. Cl.[3] ..... E05C 17/30; E05C 17/32

[52] U.S. Cl. ..... 292/339

[58] Field of Search ..... 292/263, 338, 339

[56] References Cited

U.S. PATENT DOCUMENTS

| | | | |
|---|---|---|---|
| 467,589 | 1/1892 | Finegan . | |
| 503,536 | 8/1893 | Hales . | |
| 559,382 | 5/1896 | Hoffman | 292/338 |
| 790,653 | 5/1905 | Notthoff . | |
| 837,595 | 12/1906 | Storr . | |
| 855,961 | 6/1907 | Merring . | |
| 1,944,783 | 1/1934 | Ciriacy et al. | 292/338 |
| 3,709,454 | 1/1973 | Hyde . | |
| 3,805,463 | 4/1974 | Lange et al. . | |
| 4,019,765 | 4/1977 | Nichola . | |
| 4,139,227 | 2/1979 | Spurr . | |
| 4,157,128 | 6/1979 | Peters . | |

*Primary Examiner*—Richard E. Moore

*Attorney, Agent, or Firm*—Zarley, McKee, Thomte, Voorhees & Sease

[57] ABSTRACT

The door stop mechanism wedges beneath the door knob of a closed door and against the floor to prevent the door from being opened from the outside. An over-center effect of the mechanism assures a positive lock securing position and an angular slot arrangement provides a foldable rigid mechanism without the use of other pins or fixing devices.

9 Claims, 7 Drawing Figures

DOOR STOP MECHANISM

BACKGROUND OF THE INVENTION

This invention relates to a means for securing a door and preventing the door from being opened from the outside.

Doors have typically been secured with either a dead bolt or a chain from the door to the door frame. A dead bolt can be broken by forcibly turning the doorknob. Also, anyone with a master or duplicate key can easily unlock the dead bolt. A chain can be broken by a sharp kick or blow to the door. Picking the lock and other such means are other commonly known methods for opening a locked door.

There have been some devices designed to place behind a door so as to forcefully fit between the doorknob and the floor. Some of these devices have had the disadvantage that a sharp blow to the door would dislodge the device or break a joint therein. Others of these door guards require extra pins or locking devices to secure the door.

SUMMARY OF THE INVENTION

The door stop mechanism of the present invention is forced into a locked position, with one end fit beneath a doorknob and the other end engaging the floor, so as to prevent a door from being opened from the outside. The mechanism comprises three hinged segments arranged so that the line connecting the hinge bolts lies above the line connecting the points of contact of the mechanism with the door and the floor. This arrangement creates an over center toggling action that assures a positive lock when the mechanism is in place. An angular slot arrangement in the hinge between the center and upper segments provides an ever tightening joint as compression is applied to the mechanism. Once toggled, and in the securing locked position, the device is easily unlocked with a slight pull to the lower segment. The entire mechanism folds up for compact storage.

Therefore, a primary object of the present invention is the provision of an improved door stop mechanism to prevent a door from being opened from the outside.

A further object of the present invention is the provision of a door stop mechanism that has a positive lock when the mechanism is in place without the use of pins or other fixing devices.

A further object of the present invention is the provision of a door stop mechanism with a joint that increasingly tightens as pressure is applied to the mechanism.

A further object of the present invention is the provision of a door stop mechanism that can be easily removed from inside the door from its securing position.

A further object of the present invention is a mechanism which is economical to manufacture and durable in use.

DETAILED DESCRIPTION OF THE INVENTION

Figures 1, 2, 3, 4, 5, 6, 7:
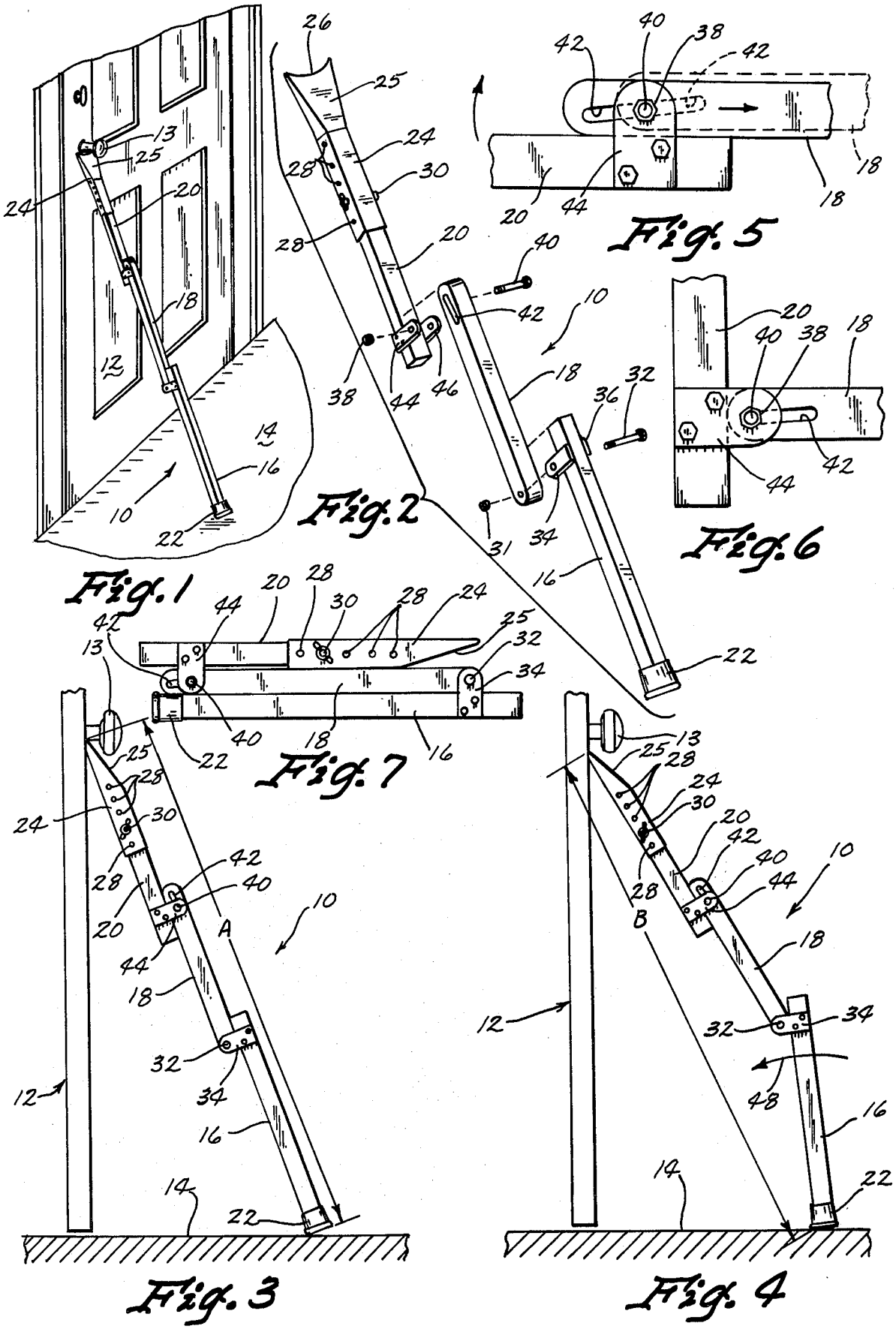
FIG. 1 is a side perspective view of the door stop mechanism in its locked securing position against the inside of a door and on the floor.
FIG. 2 is an exploded perspective view of the mechanism.
FIG. 3 is a side view of the mechanism in its locked securing position.
FIG. 4 is a side view of the mechanism in its locked position ready to be removed from the door.
FIG. 5 is a side view of the pivot means between the center and upper rod segments with the segments in the locked position.
FIG. 6 is a side view of the pivot means between the center and upper rod segments with the segments being in a partially folded position.
FIG. 7 is a side view of the mechanism as it is folded for storage.

Referring to the drawings, numeral 10 generally designates the door stop mechanism, numeral 12 indicates the door with a knob 13 and numeral 14 denotes the floor. In the locked position the mechanism has an extended length A, which is greater than length B of the mechanism when in the unlocked position. When the mechanism is moved from the unlocked position of FIG. 4 to the locked position of FIG. 3, the increase in length puts tension against the inside of the door, thus preventing the door from being forced open from the outside.

The mechanism 10 comprises a lower rod segment 16, a center rod segment 18 and an upper rod segment 20. Lower segment 16 has a rubber tip 22 fitted over its lower end to prevent marring or gouging of the floor. When the mechanism is in the locked position, the rubber tip frictionally engages the floor so as to prevent the mechanism from slipping.

Upper segment 20 has secured to it at its upper end a doorknob receiving section 24. The doorknob receiving section has a taper 25 towards its upper concave end 26 so as to assure that there is an over-center lock of the mechanism 10. The concave end is designed to receive any door lock assembly with or without a doorknob. Along the lower end of the doorknob receiving section 24 is a series of holes 28 which receive a pin 30 and allow for the section to be extended or retracted so that the overall length A of the mechanism is sufficient to provide the appropriate tension against the door.

Center segment 18 is pivotally connected to lower segment 16 by means of a nut 31 and a bolt 32 that passes through a hole in the center segment and through a pair of ears 34 and 36 attached to the upper end of the lower segment. Upper segment 20 is pivotally connected to center segment 18 by means of a nut 38 and a bolt 40 that passes through an elongated slot 42 in the center segment and through a pair of ears 44 and 46 attached to the lower end of the upper segment 20. The longitudinal axis of slot 42 is at an angle with respect to the longitudinal axis of the upper rod segment 20. Thus, when the angular slot arrangement is compressed, it forms an ever tightening joint which readily releases when extended.

In use the door stop mechanism is initially set with the lower end of the lower rod segment 16 approximately twelve inches from the bottom of the closed door 12 and the concave end 26 of the doorknob receiving section 24 just below the doorknob, as shown in FIG. 4. Placing the lower end of lower segment 16 at a distance of more or less than twelve inches from the closed door will decrease or increase, respectively, the force against the door when the mechanism is in the locked position. To put the mechanism in the locked securing position of FIG. 3, the lower segment is simply forced in the direction of arrow 48 until the upper end of lower segment 16 butts the lower end of center segment 18. As the length of the mechanism is increased from B to A, bolt 40 is forced to the lower end of slot 42 making a tight joint between the center and upper rod segments. Further force in an attempt to open the door from the outside tightens the joint even further. The geometry of the mechanism is such that the bolts 32 and 40 lie in a line above the line of force from the concave end 26 of the doorknob receiving section 24 to the point where the rubber tip 22 engages the floor, therefore creating an over-center toggling action that insures a positive lock in the mechanism without the use of pins or other fixing devices. The mechanism is released from the locked position by a slight tug on the lower segment 16 in a direction opposite that of arrow 48. The door stop mechanism folds down to a length of approximately one-third A for compact storage or transportation.

What is claimed is:

1. A door stop mechanism comprising, a lower rod segment having upper and lower ends, a center rod segment having upper and lower ends, the lower end of said center rod segment underlying the upper end of said lower rod segment and being pivotally secured thereto by a first pivot means, an upper rod segment having upper and lower ends, the lower end of said upper rod segment underlying the upper end of said center rod segment and being pivotally secured thereto by a second pivot means, said first pivot means attached to the upper end of said lower rod segment and receiving the lower end of said center rod segment, said second pivot means attached to the lower end of said upper rod segment and receiving the upper end of said center rod segment.

2. A door stop mechanism according to claim 1 wherein said first pivot means comprises a pair of ears attached to said upper end of said lower rod segment, said ears pivotally receiving said lower end of said center rod segment.

3. A door stop mechanism according to claim 1 wherein said second pivot means comprises a pair of ears attached to said lower end of said upper rod segment, said ears pivotally receiving said upper end of said center rod segment.

4. A door stop mechanism according to claim 3 wherein said upper end of said center rod segment has a pin passing through an elongated slot and through said ears of said second pivot means.

5. A door stop mechanism according to claim 4 wherein the longitudinal axis of said slot is at an angle with respect to the longitudinal axis of said center rod segment.

6. A door stop mechanism according to claim 5 wherein said slot has upper and lower ends, the length of said slot being such that when said pin is at the upper end of said slot, said upper and center rod segments can be pivoted with respect to each other, and when said pin is at the lower end of said slot, said upper and center rod segments are not pivotable with respect to each other.

7. A door stop mechanism according to claim 1 wherein said lower end of said lower rod segment is fitted with a rubber tip.

8. A door stop mechanism according to claim 1 wherein said upper end of said upper rod segment has a doorknob receiving section extendably secured thereto by a pin securing means, said doorknob receiving section having a concave upper end adapted to receive a doorknob.

9. A door stop mechanism according to claim 8 wherein said pin securing means comprises a hole in said upper end of said upper rod segment, a series of holes in said doorknob receiving section and a pin extending through said hole in said upper rod segment and through one of said series of holes in said doorknob receiving device.

* * * * *